US010479125B2

(12) United States Patent
Fukuda et al.

(10) Patent No.: US 10,479,125 B2
(45) Date of Patent: Nov. 19, 2019

(54) BOOK BINDING DEVICE

(71) Applicant: Horizon International Inc., Shiga (JP)

(72) Inventors: Shigenobu Fukuda, Shiga (JP); Takehito Yokogi, Shiga (JP); Yoshihide Iwayama, Shiga (JP)

(73) Assignee: Horizon International Inc., Shiga (JP)

( * ) Notice: Subject to any disclaimer, the term of this patent is extended or adjusted under 35 U.S.C. 154(b) by 0 days.

(21) Appl. No.: 15/772,136

(22) PCT Filed: May 15, 2017

(86) PCT No.: PCT/JP2017/018220
§ 371 (c)(1),
(2) Date: Apr. 30, 2018

(87) PCT Pub. No.: WO2018/025464
PCT Pub. Date: Feb. 8, 2018

(65) Prior Publication Data

US 2019/0152249 A1 May 23, 2019

(30) Foreign Application Priority Data

Aug. 2, 2016 (JP) ..... 2016-151642

(51) Int. Cl.
*B42C 19/00* (2006.01)
*B42C 19/08* (2006.01)
(Continued)

(52) U.S. Cl.
CPC ..... *B42C 19/08* (2013.01); *B42C 9/00* (2013.01); *B42C 9/0012* (2013.01);
(Continued)

(58) Field of Classification Search
CPC ..... B42C 19/00; B42C 19/08; B42C 19/012; B42C 19/0025; B42C 9/00; B42C 9/0025
(Continued)

(56) References Cited

U.S. PATENT DOCUMENTS 4,767,250 A * 8/1988 Garlichs ..... B42C 19/08 412/13
6,206,358 B1 * 3/2001 Yamaguchi ..... B42C 19/02 412/11

(Continued)

FOREIGN PATENT DOCUMENTS

| | | |
|---|---|---|
| JP | 2000-168264 | 6/2000 |
| JP | 2000-168265 | 6/2000 |
| JP | 2009-285906 | 12/2009 |

OTHER PUBLICATIONS

International search report dated Jul. 25, 2017 mailed in corresponding international application No. PCT/JP2017/018220.

*Primary Examiner* — Kyle R Grabowski

(57) ABSTRACT

A bookbinding device includes a control unit for calculating set parameter values for a clamper and a processing unit on the basis of thickness on a book body to be bound, and initially setting the clamper and the processing unit in accordance with the set parameter values. The control unit includes an input unit for receiving an input of a reference parameter value for two or more different book body thicknesses; a function generation unit for generating, on the basis of the reference parameter value, a function for calculating a set parameter value that has been adjusted in accordance with the book body thickness; a parameter calculation unit for calculating, on the basis of the book body thickness, the set adjusted parameter value by using the function; and an initial setting unit for initially setting the clamper and the processing unit in accordance with the set adjusted parameter value.

6 Claims, 16 Drawing Sheets

(51) Int. Cl.

| | |
|---|---|
| ***B42C 9/00*** | (2006.01) |
| ***B42C 11/04*** | (2006.01) |
| ***B42C 13/00*** | (2006.01) |
| ***B65H 29/70*** | (2006.01) |
| ***B65H 37/04*** | (2006.01) |

(52) U.S. Cl.
CPC ..... *B42C 9/0025* (2013.01); *B42C 11/04* (2013.01); *B42C 13/00* (2013.01); *B42C 19/00* (2013.01); *B65H 29/70* (2013.01); *B65H 37/04* (2013.01)

(58) Field of Classification Search
USPC ..... 412/14, 37
See application file for complete search history.

(56) References Cited

U.S. PATENT DOCUMENTS

| | | | | |
|---|---|---|---|---|
| 6,352,252 | B1 * | 3/2002 | Schmucker | B42C 19/08 412/14 |
| 6,447,230 | B1 * | 9/2002 | Takai | B42C 19/02 412/14 |
| 2003/0012622 | A1 * | 1/2003 | Itoh | B42C 9/0037 412/37 |
| 2009/0297297 | A1 * | 12/2009 | Katayama | B42C 11/04 412/14 |
| 2010/0310339 | A1 * | 12/2010 | Mueller | B42C 19/08 412/19 |
| 2011/0014012 | A1 * | 1/2011 | Muller-Lorenschat | B42C 9/0012 412/37 |
| 2011/0255939 | A1 * | 10/2011 | Winkelmann | B42C 19/08 412/33 |

* cited by examiner

BOOK BINDING DEVICE

TECHNICAL FIELD

The present invention relates to a book binding device comprising at least one clamper movable along a conveying path and a series of processing units arranged along the conveying path to carry out bookbinding, wherein a book block is bound while being gripped by the clamper and passed through the series of processing units.

BACKGROUND ART

A conventional book binding device is disclosed in, for example, Patent Document 1. The book binding device disclosed in Patent Document 1 comprises a clamper reciprocally movable along a conveying path, a series of processing units (a milling unit, a glue application unit and a cover attachment unit) arranged along the conveying path, a cover supply unit supplying a cover to the cover attachment unit, and a control unit controlling these units and the clamper.

A guide rail and an endless drive chain are arranged above the series of processing units to extend along the conveying path and the clamper is slidably attached to the guide rail and fixed to the endless drive chain. The clamper has a pair of clamp plates, and a book block (a bundle of sheets or signatures for manufacturing a book) is gripped between the pair of clamp plates at a book block supply position which is disposed at one end of the conveying path while standing with a spine thereof downwardly facing.

The milling unit includes a milling cutter and a pair of guide plates. While the book block gripped between the pair of clamp plates passes over the milling cutter, a bottom part of the book block is inserted between the pair of guide plates, and the spine of the book block is milled while being supported by the guide plates at the bottom part thereof, whereby a pretreatment for uniform application of glue to the spine of the book block is performed.

The glue application unit includes a glue tank, glue application rollers applying glue to the spine of the book block, and a scrape roller wiping out extra glue of the book block. While the book block gripped between the pair of clamp plates passes over the glue tank, the glue is applied to the spine of the book block.

The cover attachment unit includes a bottom plate and a pair of nip plates arranged on the bottom plate. The cover supplying unit includes a shelf on which the covers are placed, and a cover conveying mechanism conveying the cover from the shelf onto the base plate and pair of nip plates. The cover conveying mechanism includes a pair of scoring roller pairs forming folds at predetermined positions on the cover.

After an operation of bookbinding starts, the cover is conveyed from the shelf onto the bottom plate and pair of nip plates by the cover conveying mechanism. During conveying the cover, parallel two folds are formed on the cover by the pair of scoring roller pairs. When the book block gripped between the pair of clamp plates arrives and stops at a predetermined position on the cover attachment unit, the bottom plate as well as the pair of nip plates raises to a nipping position, thereby the cover is pressed against the spine of the book block by the bottom plate, and then the spine of the book block are nipped between the pair of nip plates so that the cover is pressed against both sides of the spine of the book block so as to be attached to the book block, and a product is manufactured.

Thereafter the guide rail and endless drive chain raise and the product gripped by the pair of clamp plates is conveyed to the book block supply position and then the product is discharged by opening the pair of clamp plates.

In this book binding device, before start of operation of the book binding device, as parameters of the book binding device, the gap distance between the pair of clamp plates of the clamper at an open position thereof, the gap distance between the pair of guide plates of the milling unit, the gap distance between the pair of nip plates of the cover attachment unit at an open position thereof, and the gap distance between the pair of scoring rollers of the cover conveying mechanism are automatically calculated by the control unit based on the information about the thickness about a book block to be bound, and then initial settings of these parameters are performed according to the calculated values, whereby the production efficiency is improved.

In some conventional book binding devices, the height of a scrape roller as a parameter of a glue application unit is automatically preset based on the information about the thickness of a book block to be bound in order to apply glue to the book block at an appropriate thickness and improve a finish of book binding. Also, in some conventional book binding devices, the height of a bottom plate with a pair of nip plates as parameters of a cover attachment unit is automatically preset based on the information about the thickness of a book block to be bound in order to achieve cover attachment suitable for the thickness of glue applied to the book block and improve a finish of book binding (for example, Patent Documents 2 and 3).

However, even if book blocks have the same thickness, because a set of sheets or signatures making up the respective book blocks do not always have the same quality and thickness, the set values of the parameters automatically calculated based on the information about the thickness of a book block to be bound by the book binding device are not always appropriate. Consequently, when a book binding is performed using the set values of the parameters automatically calculated by the book binding device, the trouble such as partial wrinkles or breaks of a book block, a paper jam, and a defect of cover attachment sometimes arises, or the quality of a finishing of book binding sometimes deteriorates. Furthermore, because an appearance of a product is subjectively evaluated and a criteria of the evaluation varies for each of users, when a bookbinding is performed using the set values of the parameters automatically calculated by the book binding device, products suitable for tastes of the users cannot sometimes be obtained.

Therefore, in the prior art, after the information about the thickness of a book block to be bound is inputted to the book binding device and the set values of the parameters automatically calculated by the book binding device, these set values are adjusted by the user depending on kinds of book blocks and then an initial setting of the book binding device is performed according to the adjusted set values of the parameters so that products suitable for the user's taste are manufactured.

However, this adjustment work is troublesome and especially, this adjustment work is required for each lot in manufacturing of a wide variety of products in small quantities, whereby the manufacturing efficiency is substantially decreased.

PRIOR ART DOCUMENTS

Patent Documents

Patent Document 1: JP 2009-285906 A
Patent Document 2: JP 2000-168264 A
Patent Document 3: JP 2000-168265 A

SUMMARY OF THE INVENTION

Problems to be Solved by the Invention

It is, therefore, an object of the present invention to provide a book binding device capable of achieving a finishing of bookbinding suitable for user's tastes without lowering the manufacturing efficiency even in the case of manufacturing a wide variety of products in small quantities.

Means for Solving the Problems

In order to solve the object, the present invention provides a book binding device comprising: at least one clamper movable along a predetermined conveying path, the clamper having one or more parameters adjustable depending on the thickness of a book block; a series of processing units arranged along the conveying path to carry out bookbinding for the book block gripped by the clamper, each of the processing units having one or more parameters adjustable depending on the thickness of the book block; a control unit operatively connected to the clamper and processing units to calculate set values of the parameters based on the information about the thickness of a book block to be bound and perform initial settings of the clamper and processing units according to the set values of the parameters, characterized in that the control unit comprises: an input section for receiving inputs of reference values of the parameters for two or more different thicknesses of the book block; a function generation section generating functions for calculating adjusted set values of the parameters depending on the thickness of the book block based on the reference values inputted to the input section; a parameter calculation section calculating the adjusted set values of the parameters using the functions based on the information about the thickness of a book block to be bound; and an initial setting section performing initial settings of the clamper and processing units according to the adjusted set values of the parameters.

According to a preferred embodiment of the present invention, the functions generated by the function generation section are linear functions. According to another preferred embodiment of the present invention, the control unit includes a memory storing a plurality of sets of the reference values of the parameters inputted to the input section, wherein the input section receives an input of choice of one set from the plurality of sets of the reference values of the parameters stored in the memory, and the function generation section generates the functions using the one set of the reference values of the parameters.

According to further preferred embodiment of the present invention, the series of processing units include a glue application unit and a cover attachment unit, wherein the glue application unit comprises: a glue tank; at least one glue application roller applying glue to a spine of the book block; a wiper provided for the glue application roller to adjust the thickness of the glue on the glue application roller; and a scrape roller wiping out extra glue of the book block, wherein the parameters of the glue application unit include the timing of the start and end of the glue application by the glue application roller to the book block, the thickness of the glue on the glue application roller, the height of the glue application roller, and the height of the scrape roller, wherein the cover attachment unit comprises; a bottom plate; and a pair of nip plates arranged on the bottom plate, wherein the parameters of the cover application unit include the gap distance between the pair of nip plates when the pair of nip plates takes a closed position, and the height of the bottom plate and pair of nip plates when the bottom plate and pair of nip plates attach a cover to the book block.

According to further preferred embodiment of the present invention, the clamper comprises a pair of clamp plates, and the parameters of the clamper include the gap distance between the pair of clamp plates when the pair of clamp plates takes an open position, and the travelling speed of the clamper, wherein the series of processing units further include a milling unit, the milling unit comprising: a milling cutter; and a pair of guide plates, wherein the parameters of the milling unit include the rotating velocity of the milling cutter and the gap distance between the pair of guide plates, and the parameters of the cover attachment unit further include a time from when the book block arrives at a cover attachment position until when the bottom plate and pair of nip plates raises at a height for attachment of the cover to the book block, and the duration of nipping the book block by the pair of nip plates. According to further preferred embodiment of the present invention, the cover attachment unit comprises a cover supplying unit, the cover supplying unit comprising: a shelf on which a stack of covers are placed; and a cover conveying mechanism conveying the cover from the shelf onto the bottom plate and pair of nip plates of the cover attachment unit, the cover conveying mechanism having a pair of scoring roller pairs scoring at predetermined positions on the cover, wherein the parameters of the cover supplying unit include the position of each of the scoring roller pairs.

Effect of the Invention

According to the present invention, when the reference values of the parameters for two or more different thicknesses of a book block are inputted to the book binding device by a user, the functions for calculating adjusted set values of the parameters depending on the thickness of the book block are generated by use of the reference values of the parameters. Then the adjusted set values of the parameters are calculated by using the functions based on the information about the thickness of a book block to be bound, and the parameters of the book binding device are automatically set according to the adjusted set values of the parameters before start of operation of the book binding device.

Thus when once a user adjusts the reference values of the parameters for two or more different thicknesses of the book block, adjusted set values of the parameters depending on the thickness of the book block are automatically calculated, and the parameters of the book binding device are automatically preset according to the adjusted set values of the parameters, whereby a finishing of bookbinding suitable for user's taste is achieved without lowering the manufacturing efficiency.

BEST MODE FOR CARRYING OUT THE INVENTION

Figure 1:
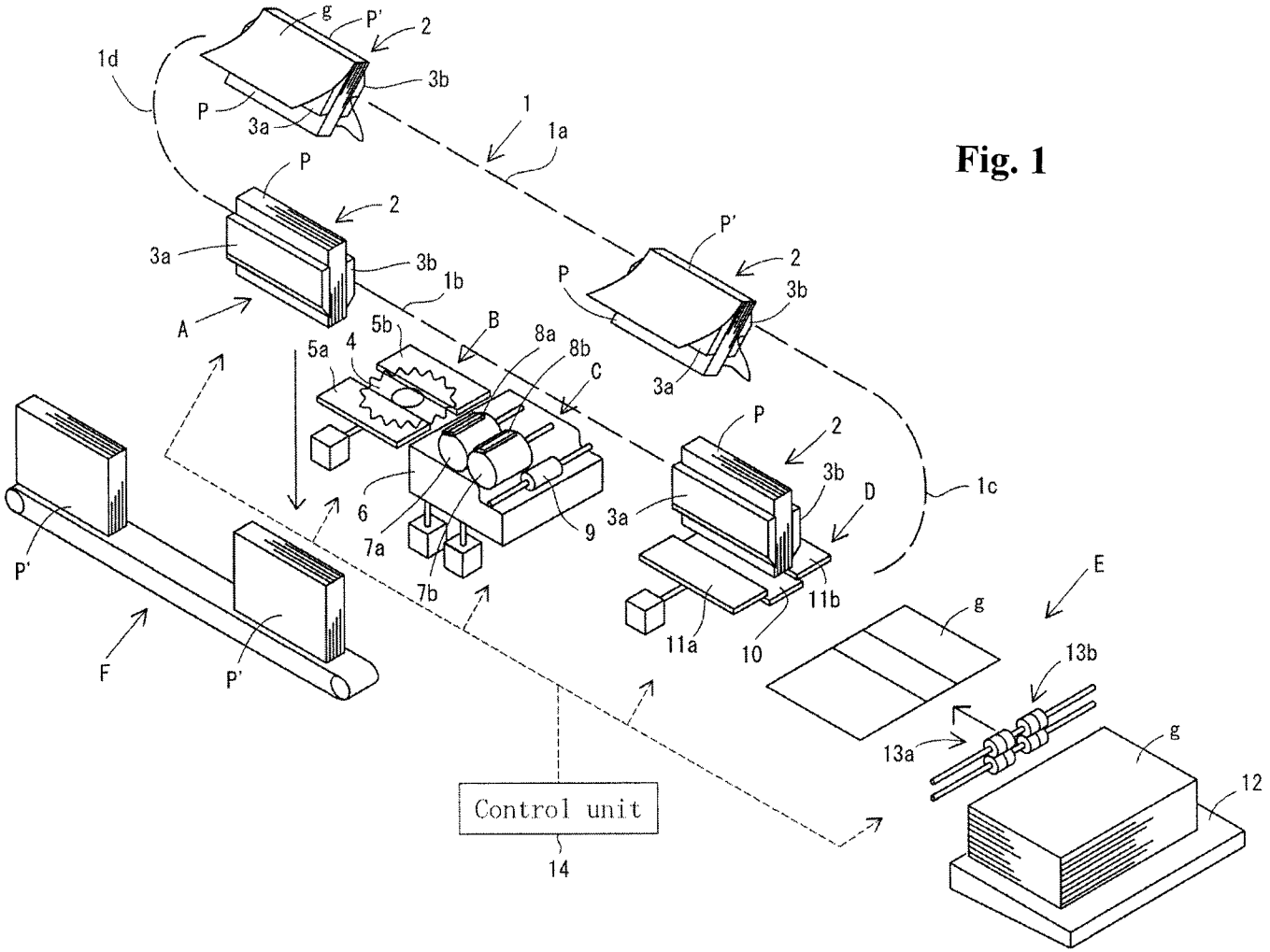
FIG. 1 is a perspective view schematically illustrating a configuration of a book binding device for carrying out perfect binding according to an embodiment of the present invention.
Figure 2:
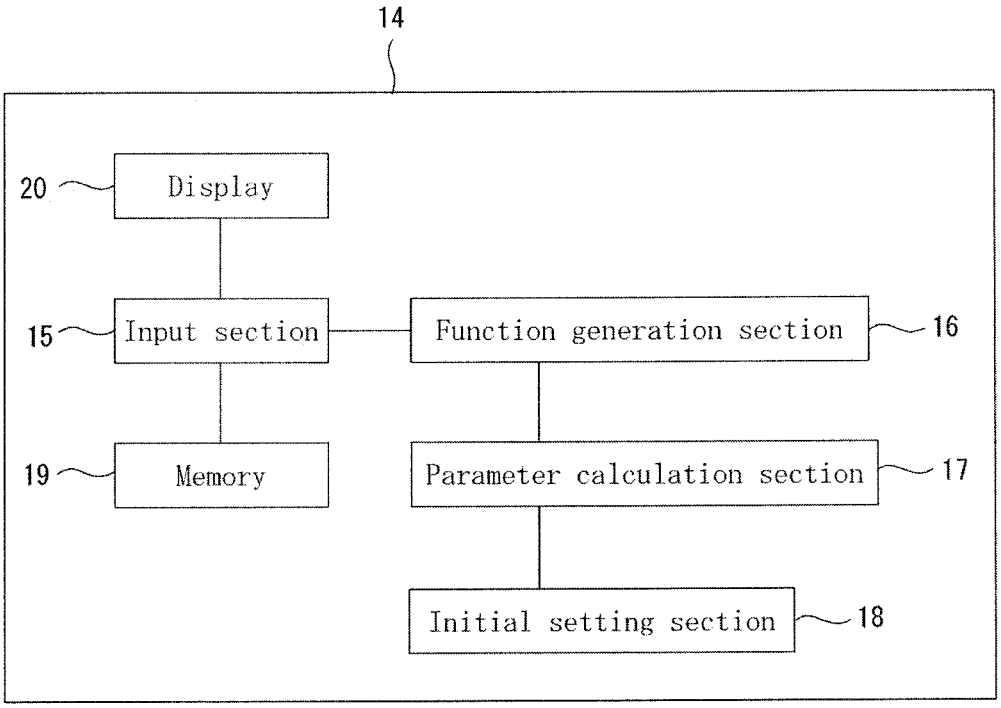
FIG. 2 is a block diagram illustrating a configuration of the control unit shown in FIG. 1.

A preferred embodiment of the present invention will be explained below with reference to accompanying drawings. FIG. 1 is a perspective view schematically illustrating a configuration of a book binding device for carrying out perfect binding according to an embodiment of the present invention. Referring to FIG. 1, according to the present invention, one or more (in this embodiment, four) clampers 2 are arranged so as to be movable along a predetermined path 1 while gripping a book block P in a standing state.

Each of the clampers 2 includes a pair of clamp plates 3*a*, 3*b* movable between an open position in which the pair of clamp plates 3*a*, 3*b* receives the book block P therebetween and a closed position in which the pair of clamp plates 3*a*, 3*b* grips the book block P therebetween. In FIG. 1, for clarity, only the pairs of clamp plates 3*a*, 3*b* are drawn on the behalf of the clampers 2.

In this embodiment, the path 1 of the clamper 2 is a loop path composed of horizontal upper and lower linear path portions 1*a*, 1*b* which are spaced from each other in a vertical plane and arcuate path portions 1*c*, 1*d* which connect ends of the upper and lower linear path portions 1*a*, 1*b*. Not shown in the drawings, a guide is arranged along the path 1. The clampers 2 are slidably attached to the guide and movable along the path 1 while being guided by the guide. The clampers 2 are moved only in one direction (counter-clockwise direction in FIG. 1) along the path 1 by an appropriate well-known drive mechanism (not shown).

In this embodiment, the travelling speed of the clamper 2 and the gap distance between the pair of clamp plates 3*a*, 3*b* when the pair of clamp plates 3*a*, 3*b* takes the open position as parameters of the clamper 2 are adjustable depending on the thickness of the book block P.

According to the present invention, a series of processing units (a milling unit B, a glue application unit C and a cover attachment unit D) are arranged along the lower linear path portion 1*b*. In FIG. 1, an alphabet E designates a cover supplying unit supplying a cover g to the cover attachment unit D. A book block supply position A is provided upstream of the series of processing units B-D on the lower linear path portion 1*b*. The book block supply position A also functions as a product discharge position.

The milling unit B comprises a milling cutter 4 and a pair of parallel guide plates 5*a*, 5*b*. The rotating velocity of the milling cutter 4 and a gap distance between the pair of guide plates 5*a*, 5*b* as parameters of the milling unit B are adjustable depending on the thickness of the book block P.

The glue application unit C comprises a glue tank 6 holding glue therein, first and second glue application rollers 7*a*, 7*b* applying the glue to a spine of the book block P, first and second wipers 8*a*, 8*b* provided for the first and second glue application rollers 7*a*, 7*b*, respectively to control the thickness of the glue on the associated glue application rollers 7*a*, 7*b*, and a scrape roller 9 wiping out extra glue of the book block P.

In this case, each of the first and second wipers 8*a*, 8*b* is movable between a closed position in which the wiper 8*a*, 8*b* contact with an outer periphery of the associated glue application roller 7*a*, 7*b* and an open position in which the wiper 8*a*, 8*b* separates a certain distance from the outer periphery of the associated glue application roller 7*a*, 7*b*. Thus the thickness of the glue on the first glue application roller 7*a* is defined by the distance between the first wiper 8*a* and the first glue application roller 7*a* when the first wiper 8*a* takes the open position, and the thickness of the glue on the second glue application roller 7*b* is defined by the distance between the second wiper 8*b* and the second glue application roller 7*b* when the second wiper 8*b* takes the open position.

In this embodiment, the timing of the start and end of the glue application by the glue application rollers 7*a*, 7*b* to the book block P (the timing of switching between the open and closed positions of the first and second wipers 8*a*, 8*b* while the book block P passes over the glue application unit C), the thicknesses of the glue on the first and second glue application rollers 7*a*, 7*b*, the height of each of the first and second glue application rollers 7*a*, 7*b*, and the height of the scrape roller 9 as parameters of the glue application unit C are adjustable depending on the thickness of the book block P.

The cover attachment unit D comprises a bottom plate 10 and a pair of nip plates 11*a*, 11*b* arranged on the bottom plate 10. The bottom plate 10 is movable between a lowered position in which the bottom plate 10 retreats downward from a cover attachment position provided on the lower linear path portion 1*b* and a raised position in which the bottom plate 10 makes contact with the book block P disposed at the cover attachment position. The pair of nip plates 11*a*, 11*b* is movable between an open position in which the pair of nip plates 11*a*, 11*b* receives the book block P therebetween and a closed position in which the pair of nip plates 11*a*, 11*b* grips the book block P therebetween.

In this embodiment, the gap distance between the pair of nip plates 11*a*, 11*b* when the pair of nip plates 11*a*, 11*b* takes the closed position, the height of the raised position of the bottom plate 10 (the height of the bottom plate 10 and pair of nip plates 11*a*, 11*b* when the bottom plate 10 and pair of nip plates 11*a*, 11*b* attach a cover to the book block), a time from when the book block P arrives at the cover attachment position until when the bottom plate 10 moves upward to the raised position, and the duration of time that the pair of nip plates 11*a*, 11*b* takes the closed position (the duration of nipping the book block by the pair of nip plates) as parameters of the cover attachment unit D are adjustable depending on the thickness of the book block P.

The cover supplying unit E comprises a shelf 12 on which a stack of covers g are placed, and a cover conveying mechanism conveying the cover from the shelf 12 onto the bottom plate 10 and pair of nip plates 11*a*, 11*b* of the cover attachment unit D. The cover conveying mechanism has a pair of scoring roller pairs 13*a*, 13*b* scoring at predetermined positions on the cover g. In FIG. 1, for clarity, only the pairs of scoring roller pairs 13*a*, 13*b* are drawn on the behalf of the cover conveying mechanism.

The pair of scoring roller pairs 13*a*, 13*b* composed of a fixed scoring roller pair 13*b* mounted on a common rotating shaft so as to be rotatable with the common rotating shaft, and a movable scoring roller pair 13*a* mounted on the common rotating shaft so as to be rotatable with the common rotating shaft and movable in directions toward and away from the fixed scoring roller pair 13*b*. In this embodiment, a position of the each of the scoring roller pairs 13*a*, 13*b* as the parameters of the cover supplying unit E is adjustable depending on the thickness of the book block P.

According to the present invention, the book binding device also comprises a control unit 14 operatively connected to the clampers 2, the drive mechanism for the clampers 2, the milling unit B, the glue application unit C, the cover attachment unit D, and the cover supplying unit E so as to calculate set values of the parameters based on the information about the thickness of a book block P to be bound and perform initial settings of the clampers 2, the drive mechanism for the clampers 2, the milling unit B, the glue application unit C, the cover attachment unit D, and the cover supplying unit E according to the set values of the parameters before start of operation of the book binding device.

In this embodiment, the information about the thickness of the book block P to be bound is obtained by measurement using an appropriate measuring equipment for the thickness of a book block P (not shown) which is arranged independently of the book binding device, and the measured value is received by the control unit 14.

The control unit 14 comprises an input section 15 for receiving inputs of reference values of the parameters for two or more different thicknesses of the book block P, a function generation section 16 generating functions for calculating adjusted set values of the parameters depending on the thickness of the book block P based on the reference values inputted to the input section 15. In this embodiment, the functions generated by the function generation section 16 are linear functions, but in another embodiment, the function generation section 16 may generate functions other than a linear function.

In this embodiment, the control unit 14 further comprises a display 20. The display 20 is a touch panel display and the touch panel thereof constitutes the input section 15.

Figure 3:
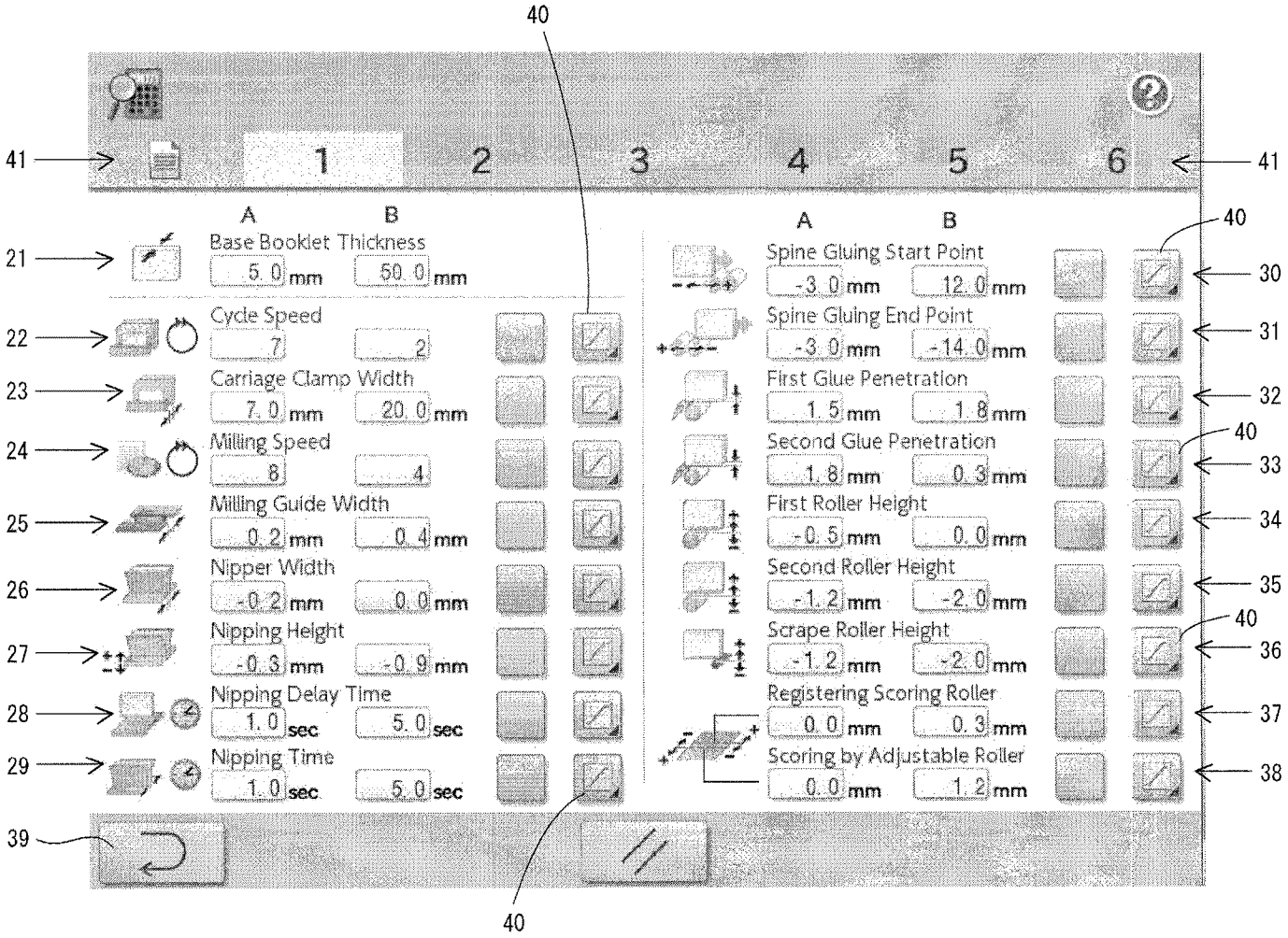
FIG. 3 is a plan view of an example of input screen displayed by an input section of the control unit shown in FIG. 2.

FIG. 3 is a plan view of an example of input screen displayed on the display 20 by the input section 15. Referring to FIG. 3, the input screen is generally divided into right and left areas. From top to bottom in the left area, a first input field "Base Booklet Thickness" 21 for inputting two different thicknesses of the book block P, a second input field "Cycle Speed" 22 for inputting the travelling speed of each clamper 2, a third input field "Carriage Clamp Width" 23 for inputting the gap distance between the pair of clamp plates 3*a*, 3*b* when the pair of clamp plates 3*a*, 3*b* takes the open position, a 4th input field "Milling Speed" 24 for inputting the rotating velocity of the milling cutter 4, a 5th input field "Milling Guide Width" 25 for inputting the gap distance between the pair of guide plates 5*a*, 5*b*, a 6th input field "Nipper Width" 26 for inputting the gap distance between the pair of nip plates 11*a*, 11*b* when the pair of nip plates 11*a*, 11*b* takes the closed position, a 7th input field "Nipping Height" 27 for inputting the height of the raised position of the bottom plate 10, an 8th input field "Nipping delay Time" 28 for inputting the time from when the book block P arrives at the cover attachment position until when the bottom plate 10 moves upward to the raised position, and a 9th input field "Nipping Time" 29 for inputting the duration of time that the pair of nip plates 11*a*, 11*b* takes the closed position are arranged.

From top to bottom in the right area, a 10th input field "Spine Gluing Start Point" 30 for inputting a start position for the first and second glue application rollers 7*a*, 7*b* to apply the glue to the book block P, an 11th input field "Spine Gluing End Point" 31 for inputting an end position for the first and second glue application rollers 7*a*, 7*b* to apply the glue to the book block P, a 12th input field "First Glue Penetration" 32 for inputting the thickness of the glue on the first glue application roller 7*a*, a 13th input field "Second Glue Penetration" 33 for inputting the thickness of the glue on the second glue application roller 7*b*, a 14th input field "First Roller Height" 34 for inputting the height of the first glue application roller 7*a*, a 15th input field "Second Roller Height" 35 for inputting the height of the second glue application roller 7*b*, a 16th input field "Scrape Roller Height" 36 for inputting the height of the scrape roller 9, a 17th input field "Registering Scoring Roller" 37 for inputting the position of the fixed scoring roller pair 13*b*, and an 18th input field "Scoring by Adjustable Roller" 38 for inputting the position of the movable scoring roller pair 13*a* are arranged.

In left column (A column) of each input field 21-38, the reference value of the associated parameter for a first thickness (in this embodiment, 5.0 mm) of the book block P is displayed, and in right column (B column) of each input field 21-38, the reference value of the associated parameter for a second thickness (in this embodiment, 50.0 mm) of the book block P is displayed.

In this input screen, when the user wants to change the reference value, the numerical value displayed in the associated input field is appropriately changed by the user, and when the user doesn't have to change the reference value, the numerical value displayed in the associated input field is not changed. When the user presses a return key 39 which is displayed at the bottom left in the input screen after finishing the change of the reference value of the parameter, the numerical numbers displayed in the input fields 21-33 as new reference values of the parameters are inputted to the control unit 14.

Then, for each of the parameters, a linear function for calculating adjusted set values of the parameter depending on the thickness of the book block P is derived by the function generation section 18 using the reference values of the first and second thicknesses of the book block P. The generation of the functions is specifically achieved by setting an XY coordinate system in which an X-axis represents the thickness of the book block P and a Y-axis represents a value of the parameter, and deriving an equation of a line passing through a point A (the first thickness of the book block A, the corresponding reference value) and a point B (the second thickness of the book block P, the corresponding reference value) in the XY coordinate system.

In this embodiment, a button for display of function graph 40 is arranged on the right side of each of the input fields 21-38, and a graph of the corresponding function is displayed on the display 20 by the button 40 being pressed.

The functions generated for the respective parameters by using the reference values of the parameters which are displayed in the input screen of FIG. 3 are shown in FIGS. 4-9. In each of FIGS. 4-9, a vertical axis of the graph represents a value of the parameter and a horizontal axis of the graph represents the thickness of the book block P.

Figure 4A:
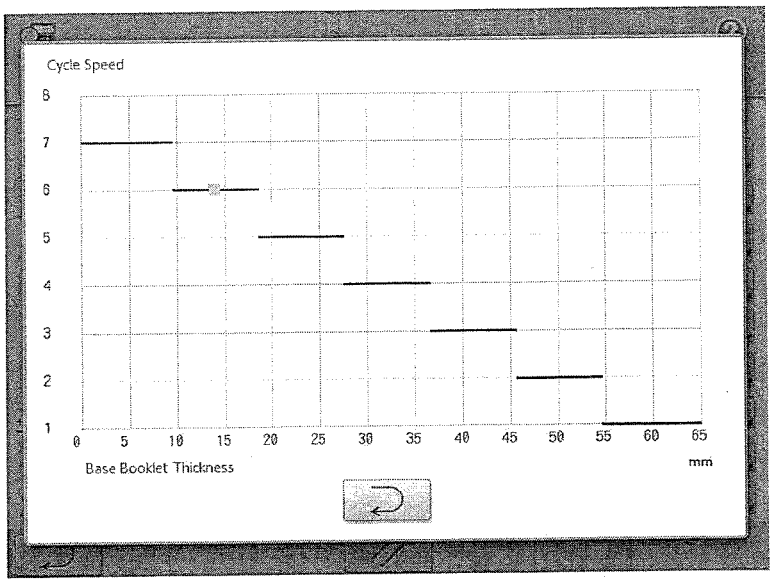
FIGS. 4A-4C are plan views of examples of screens displaying graphs of functions generated for respective parameters.
Figure 4B:
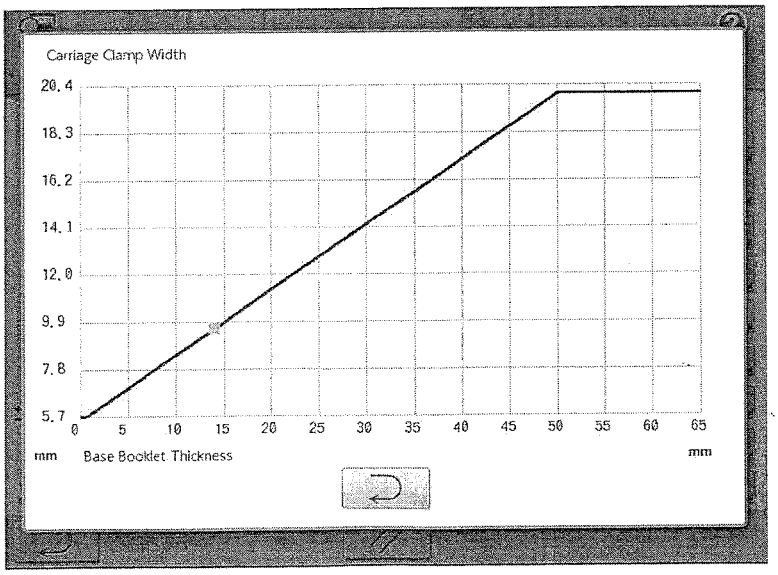
Figure 4C:
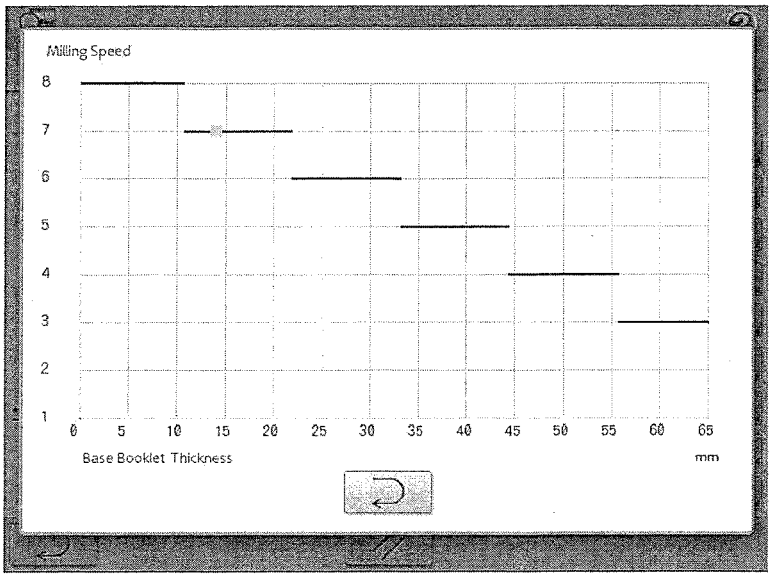

FIG. 4A is a graph of the travelling speed of the clamper 2, FIG. 4B is a graph of the gap distance between the pair of clamp plates 3*a*, 3*b* when the pair of clamp plates 3*a*, 3*b* takes the open position, and FIG. 4C is a graph of the rotating velocity of the milling cutter 4. Each of the graphs shown in FIGS. 4A and 4C is not linear but step-like because the travelling speed of the clamper 2 and the rotating velocity of the milling cutter 4 can be changed only discretely by certain mechanical restrictions of the drive mechanisms for the clamper 2 and milling cutter 4 in this embodiment. Therefore, every graph becomes linear in the case that the travelling speed of the clamper 2 and the rotating velocity of the milling cutter 4 can be changed continuously.

Figure 5A:
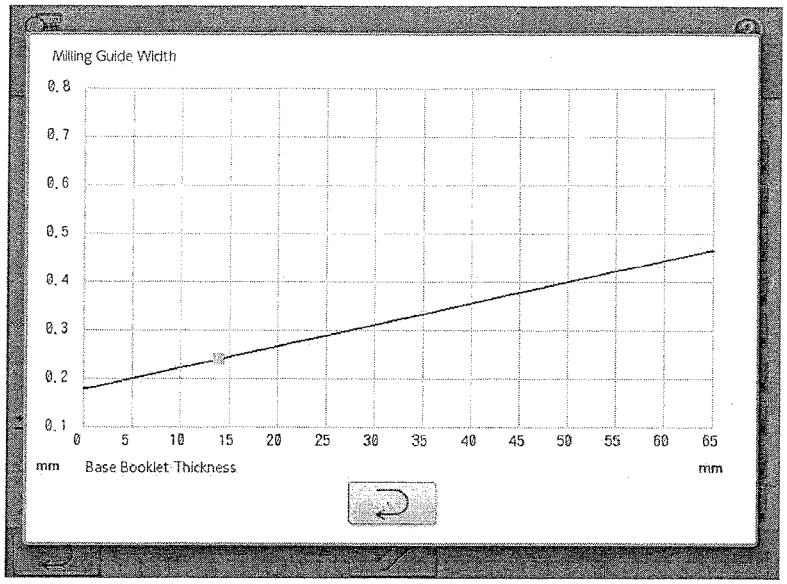
FIGS. 5A-5C are plan views of examples of screens displaying graphs of functions generated for respective parameters.
Figure 5B:
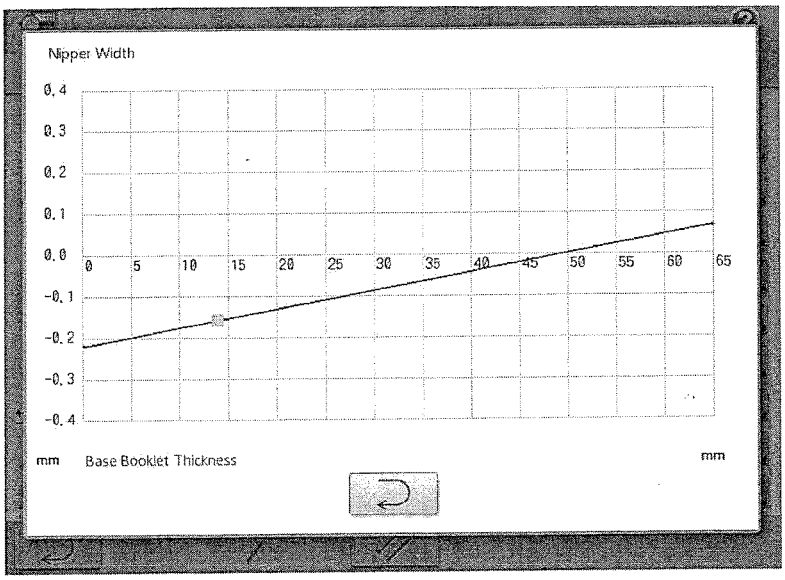
Figure 5C:
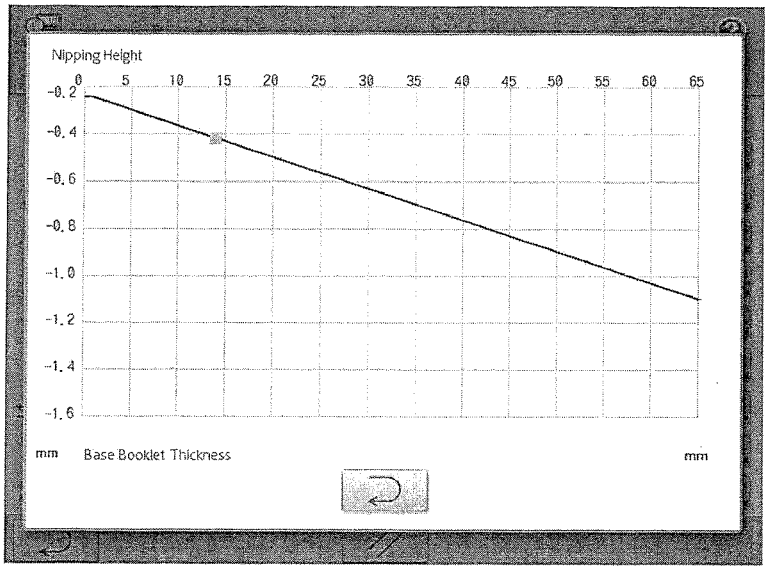
Figure 6A:
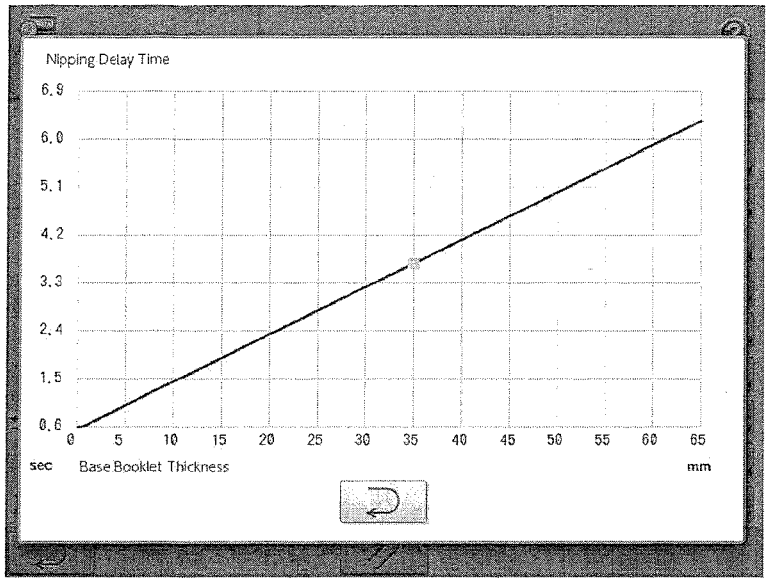
FIGS. 6A-6C are plan views of examples of screens displaying graphs of functions generated for respective parameters.
Figure 6B:
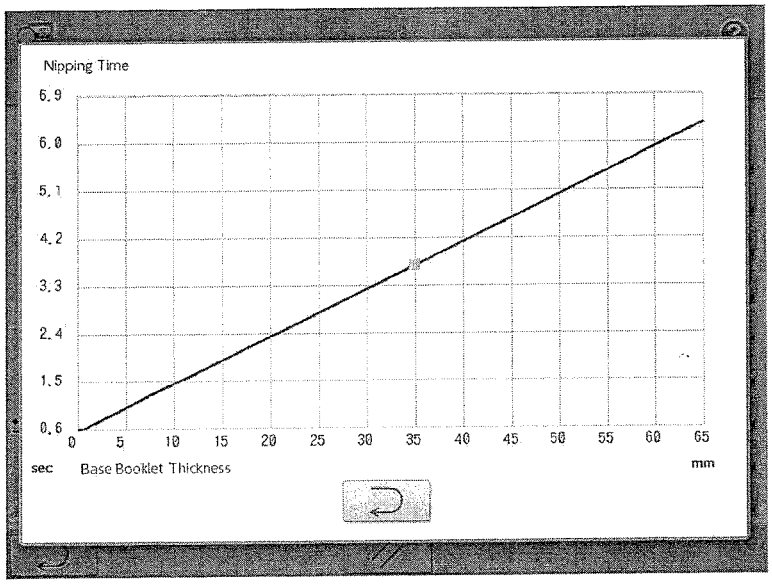
Figure 6C:
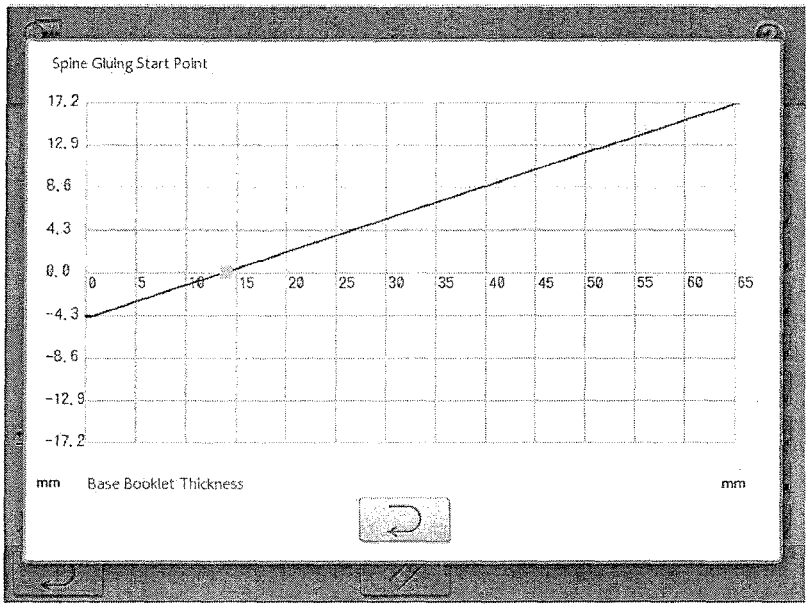

FIG. 5A is a graph of the gap distance between the pair of guide plates 5*a*, 5*b*, FIG. 5B is a graph of the gap distance between the pair of nip plates 11*a*, 11*b* when the pair of nip plates 11*a*, 11*b* takes the closed position, and FIG. 5C is a graph of the height of the raised position of the bottom plate 10. FIG. 6A is a graph of the time from when the book block P arrives at the cover attachment position until when the bottom plate 10 moves upward to the raised position, FIG. 6B is a graph of the duration of time that the pair of nip plates 11*a*, 11*b* takes the closed position, and FIG. 6C is a graph of the start position for the first and second glue application rollers 7*a*, 7*b* to apply the glue to the book block P.

Figure 7A:
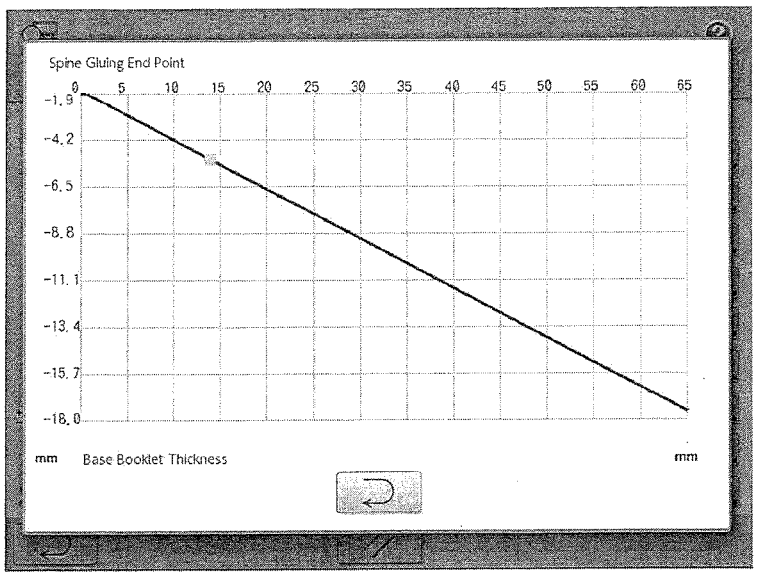
FIGS. 7A-7C are plan views of examples of screens displaying graphs of functions generated for respective parameters.
Figure 7B:
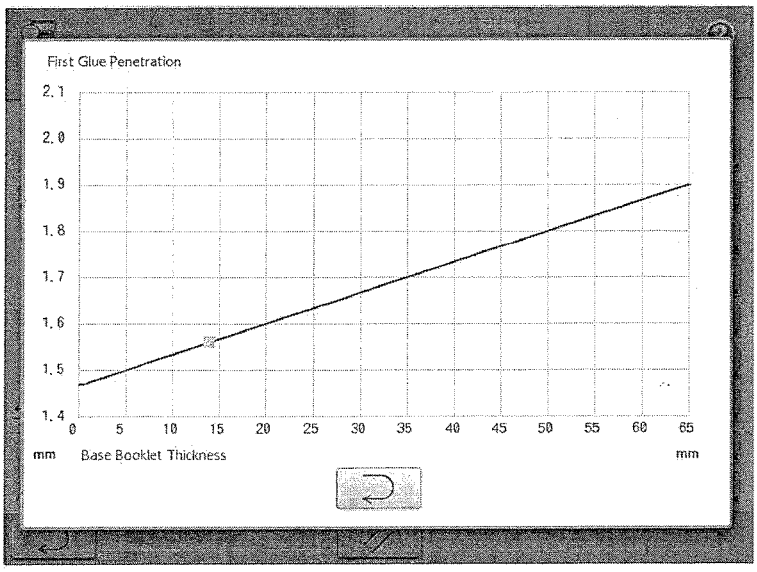
Figure 7C:
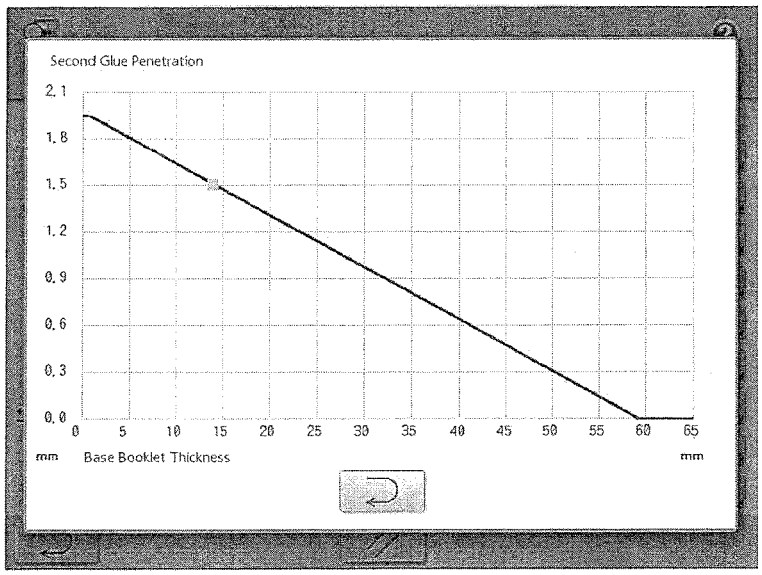
Figure 8A:
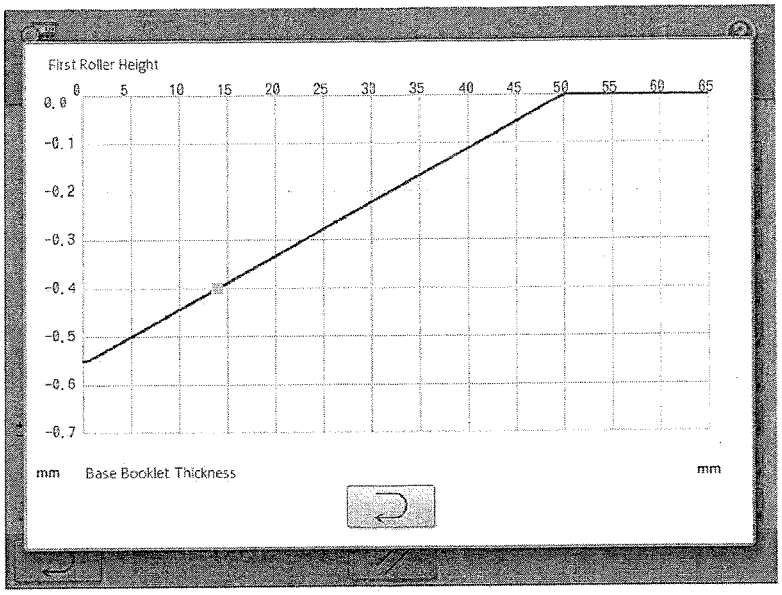
FIGS. 8A-8C are plan views of examples of screens displaying graphs of functions generated for respective parameters.
Figure 8B:
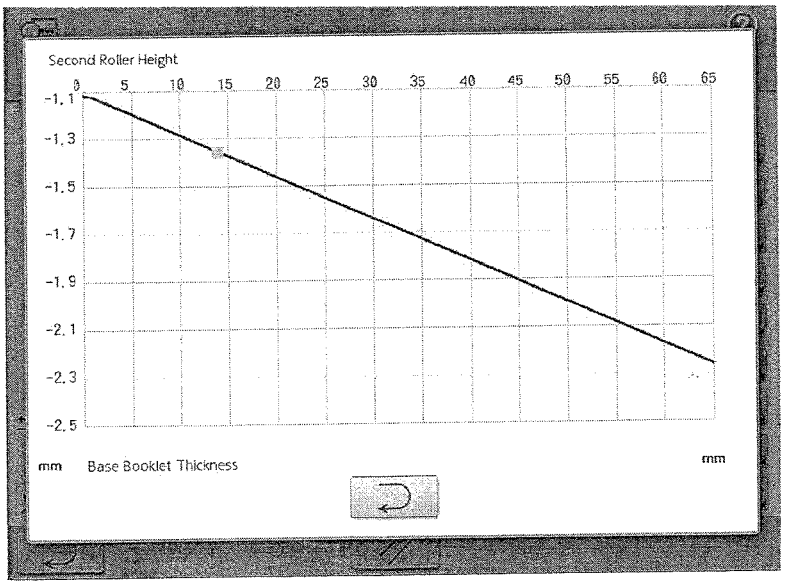
Figure 8C:
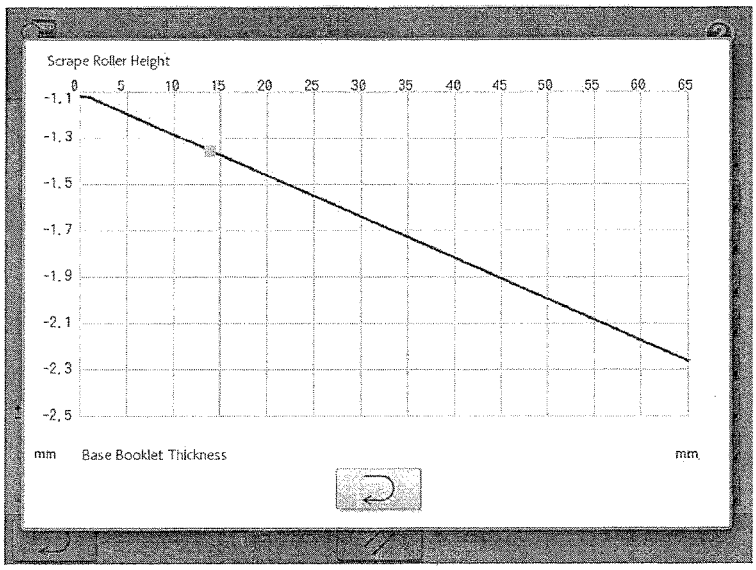

FIG. 7A is a graph of the end position for the first and second glue application rollers 7*a*, 7*b* to apply the glue to the book block P, FIG. 7B is a graph of the thickness of the glue on the first glue application roller 7*a*, and FIG. 7C is a graph of the thickness of the glue on the second glue application roller 7*b*. FIG. 8A is a graph of the height of the first glue application roller 7*a*, FIG. 8B is a graph of the height of the second glue application roller 7*b*, and FIG. 8C is a graph of the height of the scrape roller 9.

Figure 9A:
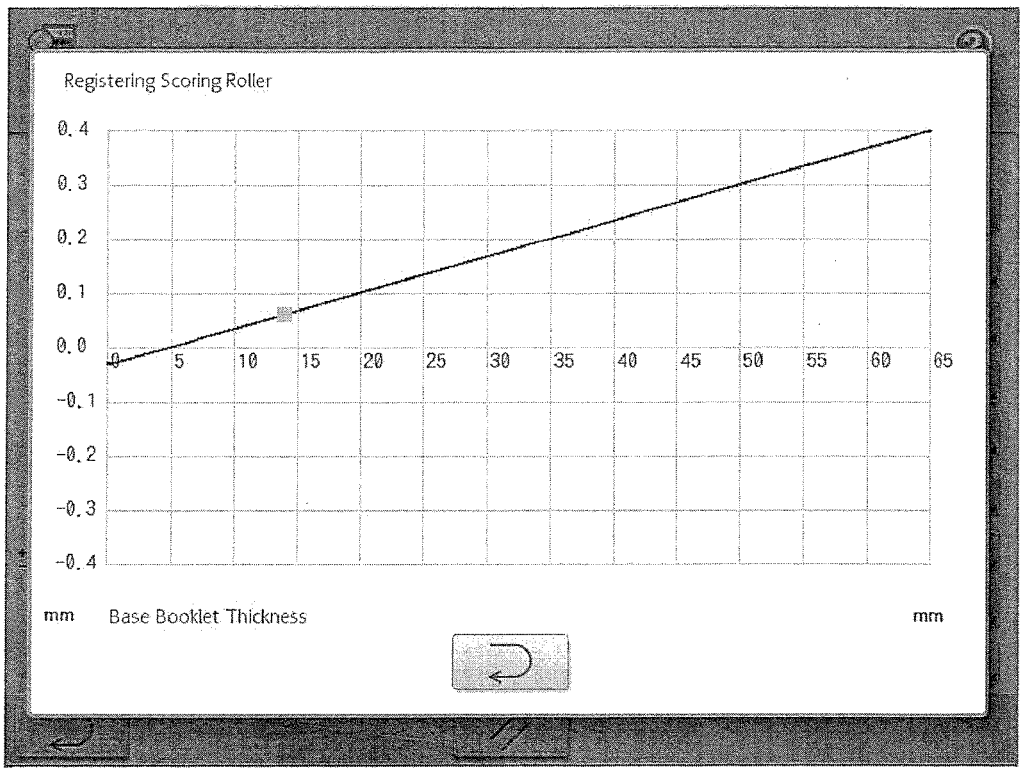
FIGS. 9A-9B are plan views of examples of screens displaying graphs of functions generated for respective parameters.
Figure 9B:
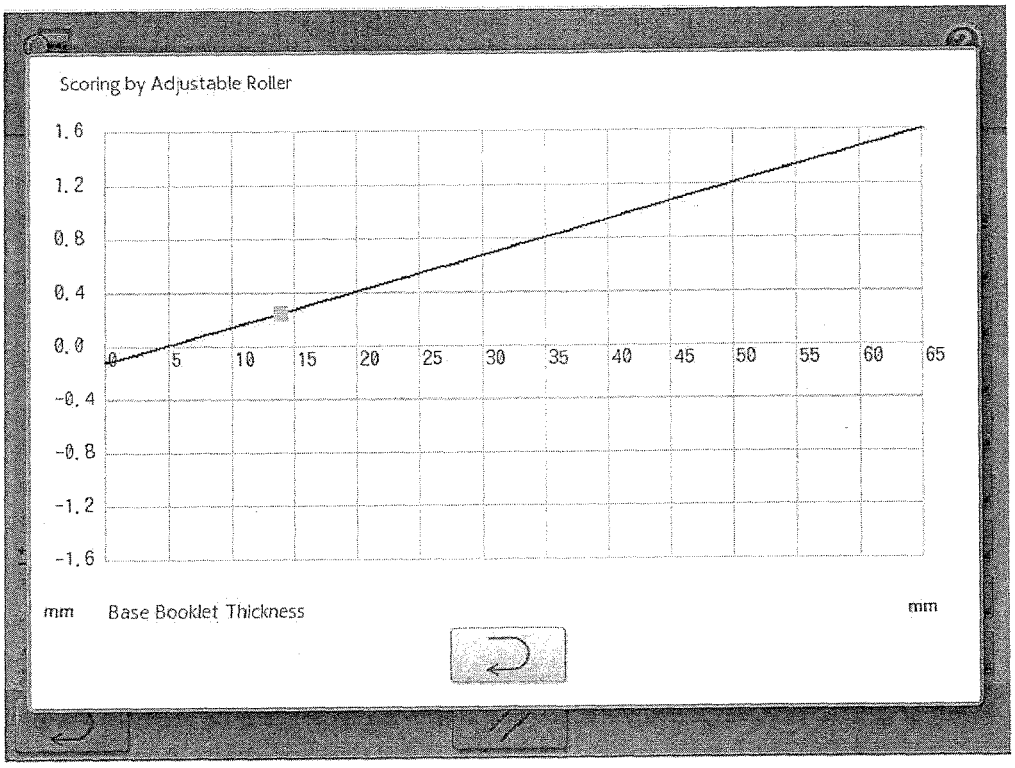
Figure 10:
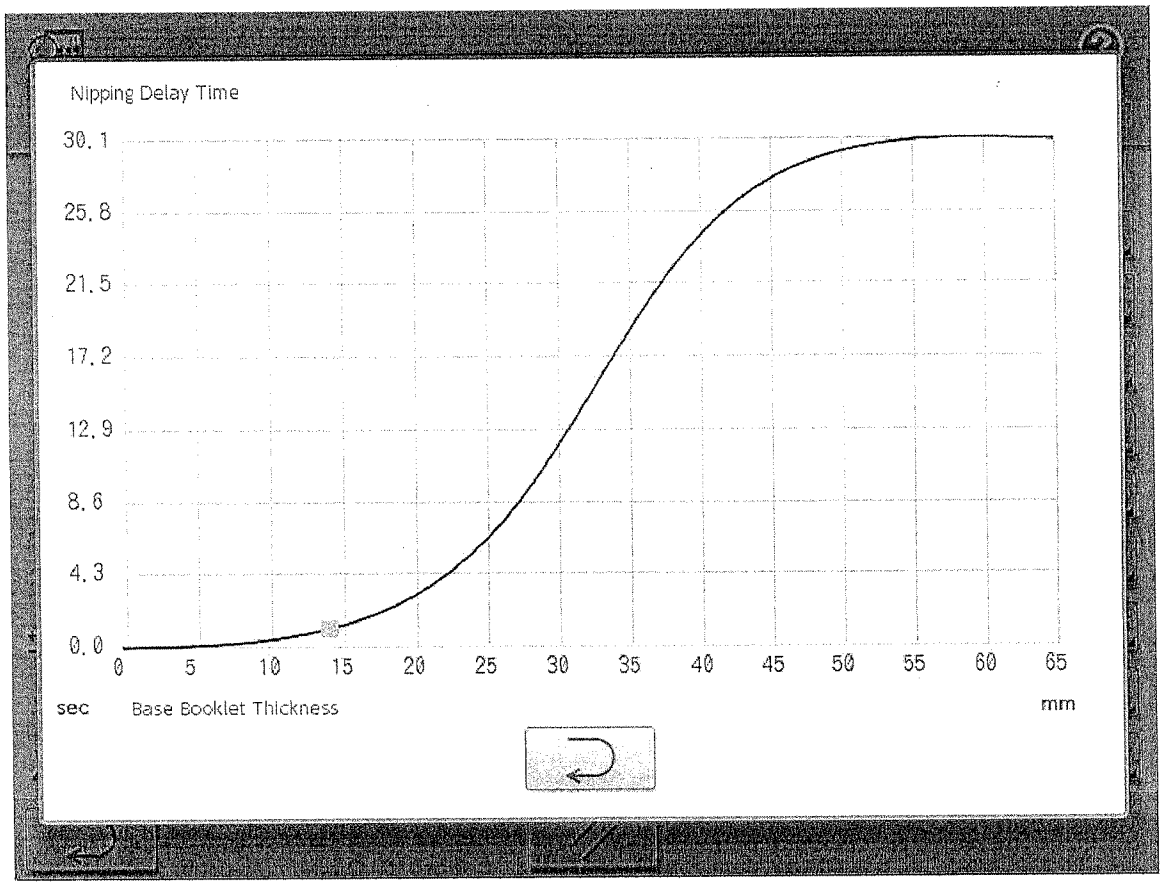
FIG. 10 is a graph of a variation of the function.

FIG. 9A is a graph of the position of the fixed scoring roller pair 13*b*, and FIG. 9B is a graph of the position of the movable scoring roller pair 13*a*. In this embodiment, although the generated functions are linear functions, according to another embodiment, functions other than a linear function may be generated as shown in FIG. 10.

In this embodiment, furthermore, as shown in FIG. 3, switching tabs 41 (designated by the numerals "1" through "6") are arranged at an upper margin of the input screen to switch between a plurality of input screens for the reference values of the parameters. Thus a plurality of sets (in this embodiment, six sets) of the reference values of the parameters can be inputted to the input section 15 by switching between the switching tabs 41. The control unit 14 also comprises a memory 19 storing the plurality of sets of the reference values of the parameters.

One set is chosen from the plurality of sets of the reference values of the parameters by choice of one tab 41 from the plural tabs 41, and next, the reference values of the parameters belonging to the chosen set are inputted to the control unit 14 by pressing the return key 39. Then the function generation section 18 generates a function by use of the inputted set of reference values of the parameters. Thereby easy and quick choice of the reference values of the parameters depending on the differences in quality and thickness, etc. of sheets or signatures of the book block P is achieved.

The control unit 14 further comprises a parameter calculation section 17 calculating the adjusted set values of the parameters using the functions generated by the function generation section 16 based on the information about the thickness of a book block P to be bound, and an initial setting section 18 performing initial settings of the clampers 2, the drive mechanism for the clampers 2, the milling unit B, the glue application unit C, the cover attachment unit D and the cover supplying unit E according to the adjusted set values of the parameters calculated by the parameter calculation section 17.

According to the present invention, when the reference values of the parameters for two or more different thicknesses of a book block are inputted to the book binding device by a user, the functions for calculating adjusted set values of the parameters depending on the thickness of the book block are generated by use of the reference values of the parameters. Then the adjusted set values of the parameters are calculated by using the functions based on the information about the thickness of a book block to be bound, and the parameters of the book binding device are automatically set according to the adjusted set values of the parameters before start of operation of the book binding device.

Thereby before an operation of bookbinding starts, the clampers 2, the milling unit B, the glue application unit C, the cover attachment unit D and the cover supplying unit E are easily and quickly preset depending on the thickness of a book block to be bound and user's taste.

After the operation of bookbinding starts, whenever the clamper 2 arrives and stops at the book block supply position A, the pair of clamp plates 3*a*, 3*b* of the clamper 2 takes the open position and the book block P is supplied to the gap between the pair of clamp plates 3*a*, 3*b* with the spine thereof facing downward by a book block supplying unit (not shown), and then the pair of clamp plates 3*a*, 3*b* takes the closed position to grip the book block P therebetween.

Next, the clamper 2 leaves the book block supply position A and moves toward the milling unit B at the preset travelling speed. The book block P is inserted between the pair of guide plates 5*a*, 5*b* at a bottom part thereof while the book block P gripped by the pair of clamp plates 3*a*, 3*b* passes over the milling cutter 4. The milling cutter 4 rotates at the preset rotating velocity, the spine of the book block P is milled while being supported by the guide plates 5*a*, 5*b* at the bottom part thereof. Thereafter the book block P gripped by the pair of clamp plates 3*a*, 3*b* is conveyed to the glue application unit C.

The first and second glue application rollers 7*a*, 7*b* engage with the spine of the book block P to apply the glue to the spine of the book block P while the book block P gripped by the pair of clamp plates 3*a*, 3*b* passes over the glue tank 6 of the glue application unit C. Then extra glue is wiped from the spine of the book block P by the scrape roller 9 so that the glue is applied to the spine of the book block P at a predetermined thickness. After the glue application is finished, the book block P gripped by the pair of clamp plates 3*a*, 3*b* is conveyed to the cover attachment unit D.

In the cover attachment unit D, when the operation of book binding starts, the cover g is conveyed from the cover supplying unit E onto the bottom plate 10 and pair of hip plates 11*a*, 11*b* by the cover conveying mechanism. During this conveyance, parallel two folds are formed at the predetermined positions on the cover g by the pair of scoring roller pairs 13*a*, 13*b*.

When the book block P gripped by the pair of clamp plates 3*a*, 3*b* stops at the cover attachment position, the bottom plate 10 as well as the pair of nip plates 11*a*, 11*b* raises at the predetermined timing to press the cover g against the spine of the book block P, further, the pair of nip plates 11*a*, 11*b* takes the closed position to press the cover g against both sides of the spine of the book block P for the predetermined time interval, whereby the cover g is attached to the book block so that a product P' is manufactured.

Thereafter the product P' arrives and stops at the book block supply position A through the arcuate path portion 1*c*, the upper path portion 1*a* and the arcuate path portion 1*d* while being gripped by the pair of clamp plates 3*a*, 3*b*. In this position, the pair of clamp plates 3*a*, 3*b* takes the open position and the product P' falls onto the product discharge unit F to be conveyed outside of the book binding device.

DESCRIPTION OF REFERENCE NUMERALS

1 Path
1*a* Upper linear path portion
1*b* Lower linear path portion
2 Clamper
3*a*, 3*b* Clamp plate
4 Milling cutter
5*a*, 5*b* Guide plate
6 Glue tank
7*a* First glue application roller
7*b* Second glue application roller
8*a* First wiper
8*b* Second wiper
9 Scrape roller
10 Bottom plate
11*a*, 11*b* Nip plate
12 Shelf
13*a* Movable scoring roller pair
13*b* Fixed scoring roller pair
14 Control unit
15 Input section
16 Function generation section
17 Parameter calculation section
18 Initial setting section
19 Memory
20 Display
21 First input field
22 Second input field
23 Third input field
24 4th input field
25 5th input field
26 6th input field
27 7th input field
28 8th input field
29 9th input field
30 10th input field
31 11th input field
32 12th input field
33 13th input field
34 14th input field
35 15th input field
36 16th input field
37 17th input field
38 18th input field
39 Return key
40 Button for display of function graph
41 Switching tab
A Book block insert position
B Milling unit
C Glue application unit
D Cover attachment unit
E Cover supplying unit
g Cover
P Book block
P' Product

The invention claimed is:

1. A book binding device, comprising:

at least one clamper movable along a predetermined conveying path while gripping a book block, the at least one clamper having one or more clamping parameters adjustable depending on a thickness of the book block;

a series of processing units arranged along the conveying path to carry out bookbinding for the book block gripped by the at least one clamper, each of the series of processing units having one or more processing parameters adjustable depending on the thickness of the book block; and a control unit operatively connected to the at least one clamper and the series of processing units to calculate default values of the one or more clamping and processing parameters based on information about the thickness of the book block to be bound, and to perform initial settings of the at least one clamper and the series of processing units according to the default values, wherein the control unit comprises:

an input section for receiving inputs of reference values of the one or more clamping and processing parameters for two or more different thicknesses of the book block;

a function generation section for generating functions based on the reference values inputted to the input section, the functions being used for calculating adjusted default values of the one or more clamping and processing parameters depending on the thickness of the book block;

a parameter calculation section for calculating the adjusted default values of the one or more clamping and processing parameters using the functions based on the information about the thickness of the book block to be bound; and an initial setting section for performing the initial settings according to the adjusted default values of the one or more clamping and processing parameters when the reference values are inputted to the input section on the one hand, and for performing the initial settings according to the default values without input of the reference values to the input section on the other hand.

2. The book binding device according to claim 1, wherein the functions generated by the function generation section are linear functions.

3. The book binding device according to claim 1, wherein the control unit includes a memory for storing a plurality of sets of the reference values of the one or more clamping and processing parameters inputted to the input section, wherein the input section receives an input of choice of one set from the plurality of sets of the reference values of the one or more clamping and processing parameters stored in the memory, and wherein the function generation section generates the functions using the chosen one set of the reference values of the one or more clamping and processing parameters.

4. The book binding device according to claim 1, wherein the series of processing units include a glue application unit and a cover attachment unit, wherein the glue application unit comprises:

a glue tank;

at least one glue application roller for applying glue to a spine of the book block;

a wiper provided for the at least one glue application roller to adjust a thickness of the glue on the at least one glue application roller; and a scrape roller for wiping extra glue off the book block, wherein the one or more processing parameters of the glue application unit include a timing of a start and an end of the glue application by the at least one glue application roller to the book block, the thickness of the glue on the at least one glue application roller, a height of the at least one glue application roller, and a height of the scrape roller; and wherein the cover attachment unit comprises:

a bottom plate; and a pair of nip plates arranged on the bottom plate, wherein the one or more processing parameters of the cover attachment unit include a gap distance between the pair of nip plates when the pair of nip plates takes a closed position, and a height of the bottom plate and the pair of nip plates when the bottom plate and the pair of nip plates attach a cover to the book block.

5. The book binding device according to claim 4, wherein the at least one clamper comprises a pair of clamp plates, and the one or more clamping parameters of the at least one clamper include a gap distance between the pair of clamp plates when the pair of clamp plates takes an open position, and a travelling speed of the at least one clamper; wherein the series of processing units further include a milling unit, wherein the milling unit comprises:

a milling cutter; and a pair of guide plates, wherein the one or more processing parameters of the milling unit include a rotating velocity of the milling cutter and a gap distance between the pair of guide plates, and wherein the one or more processing parameters of the cover attachment unit further include a time from when the book block arrives at a cover attachment position until when the bottom plate and the pair of nip plates is raised to a height for attachment of the cover to the book block, and a duration of nipping the hook block by the pair of nip plates.

6. The hook binding device according to claim 5, wherein the cover attachment unit comprises a cover supplying unit, wherein the cover supplying unit comprises:

a shelf on which a stack of covers is placed; and a cover conveying mechanism for conveying the cover from the shelf onto the bottom plate and the pair of nip plates of the cover attachment unit, the cover conveying mechanism having a pair of scoring roller pairs for scoring at predetermined positions on the cover, wherein the one or more processing parameters of the cover supplying unit include a position of each of the scoring roller pairs.

* * * * *